US011339622B2

(12) United States Patent
Dubuc et al.

(10) Patent No.: US 11,339,622 B2
(45) Date of Patent: May 24, 2022

(54) DIVERTER DOWNHOLE TOOL AND ASSOCIATED METHODS

(71) Applicant: Select Energy Systems Inc., Calgary (CA)

(72) Inventors: Derek Dubuc, Midale (CA); Kelly Jones, Calgary (CA)

(73) Assignee: Select Energy Systems Inc., Calgary (CA)

( * ) Notice: Subject to any disclaimer, the term of this patent is extended or adjusted under 35 U.S.C. 154(b) by 62 days.

(21) Appl. No.: 16/891,681

(22) Filed: Jun. 3, 2020

(65) Prior Publication Data

US 2020/0386067 A1 Dec. 10, 2020

Related U.S. Application Data

(60) Provisional application No. 62/856,864, filed on Jun. 4, 2019.

(51) Int. Cl.

| | |
|---|---|
| ***E21B 21/10*** | (2006.01) |
| ***E21B 23/06*** | (2006.01) |
| ***E21B 33/12*** | (2006.01) |
| ***E21B 23/00*** | (2006.01) |
| *E21B 7/06* | (2006.01) |

(52) U.S. Cl.

CPC ..... *E21B 23/06* (2013.01); *E21B 23/004* (2013.01); *E21B 33/12* (2013.01); *E21B 7/061* (2013.01); *E21B 21/103* (2013.01); *E21B 2200/06* (2020.05)

(58) Field of Classification Search

CPC ..... E21B 23/06; E21B 33/12; E21B 23/004; E21B 7/061; E21B 2200/06; E21B 21/103

See application file for complete search history.

(56) References Cited

U.S. PATENT DOCUMENTS

| | | | | |
|---|---|---|---|---|
| 1,327,077 | A * | 1/1920 | Abercrombie | E21B 23/06 166/181 |
| 2,058,103 | A * | 10/1936 | Phipps | E21B 33/1291 166/129 |
| 2,288,233 | A * | 6/1942 | Every | E21B 34/06 166/101 |
| 2,874,931 | A | 2/1959 | Baker et al. | |
| 3,417,827 | A * | 12/1968 | Smith | E21B 33/1243 175/4.52 |
| 5,396,953 | A | 3/1995 | Holder et al. | |
| 6,289,990 | B1 * | 9/2001 | Dillon | E21B 34/08 166/319 |
| 7,357,198 | B2 | 4/2008 | McGarian et al. | |
| 7,971,646 | B2 | 7/2011 | Murrary et al. | |
| 8,006,952 | B2 | 8/2011 | Wygnanski | |

(Continued)

*Primary Examiner* — Steven A Macdonald

(74) *Attorney, Agent, or Firm* — Siritzky Law, PLLC

(57) ABSTRACT

A downhole tool having a diverter component for directing fluids in different directions within a wellbore. The diverter component has an outer pipe which forms part of the downhole string. The pipe has a through channel and holes through the wall of the pipe. Within the pipe is a sleeve which can be moved. In one position, the sleeve blocks the wall holes and allows fluid to pass through the channel of the pipe. The diverter component may be used in conjunction with packers to seal off sections of the wellbore. The diverter and packer assembly could be used to introduce acid into particular portions of the wellbore.

15 Claims, 9 Drawing Sheets

(56) References Cited

U.S. PATENT DOCUMENTS

| | | | | |
|---|---|---|---|---|
| 9,145,748 | B1 * | 9/2015 | Meier | E21B 21/103 |
| 10,927,648 | B2 * | 2/2021 | Stang | E21B 1/00 |
| 2008/0135248 | A1 * | 6/2008 | Talley | E21B 34/14 166/285 |
| 2010/0242586 | A1 * | 9/2010 | Elshahawi | E21B 33/1243 73/152.39 |
| 2010/0282476 | A1 * | 11/2010 | Tessier | E21B 34/08 166/373 |
| 2011/0198096 | A1 * | 8/2011 | Mailand | E21B 34/14 166/373 |
| 2015/0083440 | A1 * | 3/2015 | Andersen | E21B 43/14 166/387 |
| 2015/0159469 | A1 * | 6/2015 | Purkis | E21B 34/14 166/373 |
| 2015/0184489 | A1 * | 7/2015 | Resweber | E21B 43/261 166/289 |
| 2016/0024899 | A1 * | 1/2016 | Lynn | E21B 43/255 166/305.1 |
| 2017/0254171 | A1 * | 9/2017 | Cleven | E21B 43/26 |
| 2018/0038202 | A1 * | 2/2018 | Williamson | E21B 47/09 |
| 2019/0309601 | A1 * | 10/2019 | Grieco | E21B 43/12 |

* cited by examiner

DIVERTER DOWNHOLE TOOL AND ASSOCIATED METHODS

RELATED APPLICATION

This application claims priority from U.S. provisional application 62/856,864 filed on 4 Jun. 2019. U.S. provisional application 62/856,864 is hereby fully incorporated by reference in its entirety and for all purposes.

FIELD OF THE INVENTION

The invention relates to downhole oil and gas downhole tools. In particular, the invention relates to acidizing and production tools.

BACKGROUND

Currently when acid is pumped into a formation, a considerable amount of acid can be lost downhole and so does not make it to the perforations. The result is an inferior acid squeeze along with wasted acid that didn't make to the perforations in the wellbore. Wellbore cleanup may also become costly. Current acid squeezes are preformed using a multitude of equipment, which in turn becomes very expensive to redress and service if the equipment is damaged.

Acidizing involves pumping acid into a wellbore or geologic formation that is capable of producing oil and/or gas. The purpose of any acidizing is generally to improve a well's productivity or injectivity. There are three general categories of acid treatments: acid washing; matrix acidizing; and fracture acidizing.

In acid washing, the objective is simply tubular and wellbore cleaning. Treatment of the formation is not intended. Acid washing is most commonly performed with hydrochloric acid (HCl) mixtures to clean out scale (such as calcium carbonate), rust, and other debris restricting flow in the well.

Matrix and fracture acidizing are both formation treatments. The purpose of matrix or fracture acidizing is to restore or improve an oil or gas well's productivity by dissolving material in the productive formation that is restricting flow, or to dissolve formation rock itself to enhance existing, or to create new flow paths to the wellbore. Two key factors dominate the treatment selection and design process when planning an acid job; formation type and the ability of fluid to flow through the formation in its natural state.

In matrix acidizing, the acid treatment is injected below the formation fracturing pressure.

In fracture acidizing, acid is pumped above the formation fracturing pressure.

SUMMARY

In accordance with the invention, there is provided a downhole string assembly comprising:

an upper packer;

a diverter component attached to and below the upper packer, the diverter component comprising:

an outer pipe having a pipe wall forming a pipe channel with a pipe-channel inlet and a pipe-channel outlet, and wherein the wall comprises one or more pipe-wall holes configured to allow fluid to pass between the pipe-channel interior and the pipe-channel exterior;

a configurable component, the configurable component being moveable between a through-channel configuration and a through-wall configuration, wherein:

in the through-channel configuration, the configurable component is positioned to occlude the wall holes of the outer pipe and to allow fluid flow through the pipe channel; and in the through-wall configuration, the configurable component is configured to occlude the pipe channel and to allow fluid flow through the pipe wall holes; and a lower packer, the lower packer configured to receive fluid delivered through the diverter component when in the through-channel configuration.

The lower packer may be configured to be set and unset by rotating the string. The lower packer may be configured to be set and unset by rotating the upper packer. The lower packer may comprise drag blocks to prevent rotation of a portion of the lower packer. The lower packer may comprise one or more slips. The slips may be configured to be set and unset in response to rotating the top of the packer with respect to the bottom of the packer. The lower packer may have a through channel to allow fluid received from the diverter component to pass beyond the lower packer to, for example, other elements in the string.

The configurable component may be moveable based on rotation of the string. The configurable component may be moveable based on relative rotation of the top and bottom of the diverter component.

The diverter and the lower packer may be configured such that:

in response to rotation of the string in a first direction, the lower packer is configured to set first, and then the diverter is configured to move to the through-wall configuration (e.g. from the through-channel configuration); and in response to rotation of the string in a second opposite direction, the diverter is configured first to move to the through-channel configuration (e.g. from the through-wall configuration) and then the lower packer is configured to unset to allow the string to be moved within the wellbore.

The handedness of the diverter may be dependent on other downhole tools in the string. Depending on the downhole application it may be necessary to have left or right hand rotation which would manipulate both top and bottom packers.

The upper packer may be a compression-set packer.

The configurable component may be an inner sleeve. The inner sleeve may comprise an enclosed channel portion within the outer pipe.

According to another aspect, there is provided a downhole string component comprising:

an outer pipe formed by a first pipe component and a second pipe component, the first and second pipe components being rotatable relative to each over about the diverter axis, the outer pipe being configured to provide a pipe wall forming a pipe channel with a pipe-channel inlet and a pipe-channel outlet, and wherein the wall comprises one or more pipe-wall holes configured to allow fluid to pass between the pipe-channel interior and the pipe-channel exterior;

an inner sleeve, the inner sleeve being configured within the outer pipe and to have a screw engagement with the first pipe component of the outer pipe and a sliding engagement with the second pipe component, and being moveable between a through-channel configuration and a through-wall configuration based on rotation between the first and second components, wherein:

in the through-channel configuration, the inner sleeve is positioned to occlude the wall holes of the outer pipe and to allow fluid flow through the pipe channel; and in the through-wall configuration, the inner sleeve is configured to occlude the pipe channel and to allow fluid flow through the pipe wall holes.

The inner sleeve may be rigid. The inner sleeve may be of unitary construction.

The inner sleeve may comprise a sleeve wall which has one or more sleeve-wall holes. The sleeve wall may be configured to occlude the pipe holes in the through-channel configuration, and the sleeve-wall holes are configured to align with the pipe holes in the through-wall configuration (i.e. to allow fluid flow through the sleeve-wall and pipe holes).

The inner sleeve may comprise a plug positioned towards a lower end of the sleeve, wherein the plug is configured to occlude the pipe-channel outlet in the through-wall configuration.

The outer pipe may comprise one or more vents which are open in both through-channel and through-wall configurations and are configured to allow fluid communication between the pipe-channel interior and the pipe-channel exterior. The outer pipe may comprise one or more vents which are open in all configurations of the sleeve.

The vents may be sealable by plugs.

The inner sleeve may comprise a sleeve wall forming a sleeve channel with a sleeve channel inlet and a sleeve channel outlet.

The inner sleeve may comprise a sleeve wall having sleeve-wall holes and wherein the sleeve wall is configured to occlude the pipe holes in the through-channel configuration, and the sleeve-wall holes are configured to align with the pipe holes in the through-wall configuration.

The inner sleeve and the outer pipe may comprise complementary annular surfaces within the pipe channels, the annular surfaces being arranged at an angle (between 40° and 90°) to the pipe axis such that:

when the complementary annular surfaces abut by moving the inner sleeve within the pipe along the pipe axis, the pipe channel is occluded; and when the complementary annular surfaces are spaced apart by moving the inner sleeve within the pipe along the pipe axis, fluid flow is allowed through the pipe channel.

The sleeve may comprise sleeve outlets located on surfaces which lie parallel to the diverter axis.

The sleeve may be configurable to be in an intermediate position between the through-channel configuration and the through-wall configuration. In some embodiments, when the diverter is in an intermediate configuration, the through-wall holes are partially open at the same time as fluid is allowed to flow through the channel. In some embodiments, when the diverter is in an intermediate configuration, the through-wall holes are closed at the same time as fluid is prevented to flow through the channel.

According to a further aspect, there is provided a method of using a downhole string to introduce an acid treatment, the string comprising a diverter and a lower packer positioned below the diverter, wherein the diverter is configurable between a through-channel configuration and a through-wall configuration based, wherein:

in the through-channel configuration, fluid flow is allowed through the string; and in the through-wall configuration, the fluid flow in the string is diverted into the annulus above the lower packer by the diverter.

the method comprising:

lowering a string into a wellbore in a through-channel configuration to a first position (e.g. within the wellbore such that the axial position of the upper portion of the string is fixed), when in the first position:

setting the lower packer;

configuring the diverter from the through-channel configuration to the through-wall configuration;

introducing acid into the annulus after the diverter has been configured to the through-wall configuration and after the upper packer has been set.

In some scenarios, the string may be lowered into the wellbore in a through-wall configuration to the first position.

The string may comprise an upper packer and the method may comprise setting the upper packer when the lower packer is set. Acid may be introduced into the annulus after the diverter has been configured to the through-wall configuration and after the upper packer has been set.

The acid may comprise hydrochloric acid. The acid may comprise acetic acid.

The method may comprise, after the acid is introduced at the first position:

unsetting the upper and lower packers;

reconfiguring the diverter from the through-wall configuration to the through-channel configuration; and moving the string within the wellbore with the diverter in the through-channel configuration to a second position.

The method may comprise: resetting the packers and injecting acid when the string is in the second position. This may mitigate the need to recover the entire string to surface and/or facilitate single-run operation.

The configurable component may be the sleeve.

The straddle between the upper and lower packer may be between 1 meter and 30 meters.

The downhole string assembly may comprise a replaceable spacer positioned between the upper and lower packers to control the straddle.

The present diverter design may allow the rotation of the equipment below the diverter sub to operate the downhole equipment with the fluid in place.

The string may be open at the bottom such that, when the assembly is in the through-channel configuration, the surface and the wellbore below the string bottom are in fluid communication. This allows the pressure in the string to be equalized with the wellbore bottom.

The present apparatus may give the operator the ability to hold a column of fluid without losing it downhole.

The device may be left-handed or right-handed. Two components can be changed out to make the device a left hand or right hand open. For example, the only two components that change may be the rotating mandrel portion and sleeve. This would also allow the operator more options to run different pieces of equipment depending on the work that needs to be performed.

A sub may be considered to be any small component of the downhole string, such as a short drill collar or a thread crossover.

The diverter or assembly may be used in one or more of: acid stimulations; acid washing; matrix acidizing; and fracture acidizing.

According to a further aspect, there is provided a downhole string component comprising:

an outer pipe formed by a first and second pipe components, the first and second pipe components being telescopically engaged along the diverter axis and forming a pipe channel with a pipe-channel inlet and a pipe-channel outlet, wherein the second component comprises one or more pipe-wall holes configured to allow fluid to pass between the pipe-channel interior and the pipe-channel exterior;

and wherein the first component comprises an inner sleeve, the inner sleeve being configured to have a telescopic engagement with the second component, and being moveable between a through-channel configuration and a through-wall configuration based on movement of the first component relative to the second component along the diverter axis, wherein:

in the through-channel configuration, the inner sleeve is positioned to occlude the wall holes of the second component and to allow fluid flow through the pipe channel; and in the through-wall configuration, the inner sleeve is configured to occlude the pipe channel and to allow fluid flow through the pipe wall holes.

The downhole string component may comprise a biasing mechanism. The biasing mechanism may comprise a spring configured to extend a telescopic diverter along the diverter axis. The biasing mechanism may bias the diverter to be in a through-channel configuration. The biasing mechanism may comprise a spring.

The diverter may be connected to a downhole assembly comprising a lower packer and an upper packer. The upper packer may be a compression-set packer. The setting force for the upper packer may be greater than the setting force of the diverter (e.g. so that as weight is applied, the diverter sets first). The diverter may be configured to set at 1,000-5,000 lbs (4,500-22,000 N) and the upper packer is configured to set at 7,000-15,000 lbs (31,000-67,000 N).

The assembly may be configured to be used in an open-hole or uncased portion of the well. The assembly may be configured to be used in an cased portion of the well.

The lower packer may be an open-hole packer.

The lower packer may have a deformable packer element more than 20 inches (50 cm) and/or less than 40 inches (100 cm) (e.g. 24 inches or 60 cm) along the string axis (e.g. in the unset configuration).

Acid stimulations may be considered to be the treatment of a reservoir formation with a stimulation fluid containing a reactive acid. In sandstone formations, the acid reacts with the soluble substances in the formation matrix to enlarge the pore spaces. In carbonate formations, the acid dissolves the entire formation matrix. In each case, the matrix acidizing treatment improves the formation permeability to enable enhanced production of reservoir fluids. Matrix acidizing operations are ideally performed at high rate, but at treatment pressures below the fracture pressure of the formation. This enables the acid to penetrate the formation and extend the depth of treatment while avoiding damage to the reservoir formation.

A packer is a device that can be run into a wellbore with a smaller initial outside diameter that then expands externally to seal the wellbore. Packers may employ flexible, elastomeric elements that expand. Packers may comprise slips configured to grip the inside of the wellbore.

A rotation-set packer may be considered to be a type of downhole packer that is activated or set by rotating the top of the drill string relative to the bottom. The bottom of the drill string may be restricted from rotating using drag blocks.

A compression-set packer may be considered to be a type of downhole packer that is activated or set by applying compressive force to the packer assembly. This may be achieved using set-down weight from the string, which may be controlled by the driller or operator observing the weight indicator on the rig or coiled tubing unit.

Swabbing a wellbore may involve reducing pressure in a wellbore by moving pipe, wireline tools or rubber-cupped seals up the wellbore. If the pressure is reduced sufficiently, reservoir fluids may flow into the wellbore and towards the surface. Swabbing is generally considered harmful in drilling operations, because it can lead to kicks and wellbore stability problems. In production operations, however, the term is used to describe how the flow of reservoir hydrocarbons is initiated in some completed wells.

The annulus may be considered to be the space between two concentric objects, such as between the wellbore and the string, where fluid can flow. The string may comprise pipe, drill collars, drill pipe, casing and/or tubing.

A wellbore is a drilled hole or borehole, including the open-hole or uncased portion of the well. Borehole may refer to the inside diameter of the wellbore wall, the rock face that bounds the drilled hole.

A lug may be considered to be a projection on an object. A lug may be configured to engage with and slide along a corresponding slot.

A hydraulically hold-down is a down-hole device which is activated by the tubing and annulus pressure. When the tubing pressure exceeds annulus pressure, the hydraulic hold-down may be configured to force projections or buttons outward to engage a casing. When the annulus pressure exceeds tubing pressure, the projections or buttons may be retracted (e.g. by being spring-loaded).

In the context of this technology, upper, lower, top and bottom are defined with respect to the string when in an upright position. That is, upper and top are towards the surface and lower and bottom are farther away along the well from the surface hole. Likewise, in the context of this invention, the inlet is typically towards the top and the outlet is towards the bottom. This means that when fluid is being introduced from surface into a formation, the fluid can flow into the inlet and, when the diverter is so configured, out through the outlet. It will be appreciated that downhole tools may be configured to extract material from the well in which case fluid may flow into the outlet and out of the inlet in a retrograde flow.

BRIEF DESCRIPTION OF THE DRAWINGS

Various objects, features and advantages of the invention will be apparent from the following description of particular embodiments of the invention, as illustrated in the accompanying drawings. The drawings are not necessarily to scale, emphasis instead being placed upon illustrating the principles of various embodiments of the invention. Similar reference numerals indicate similar components.

DETAILED DESCRIPTION

Introduction

Figure 1A:
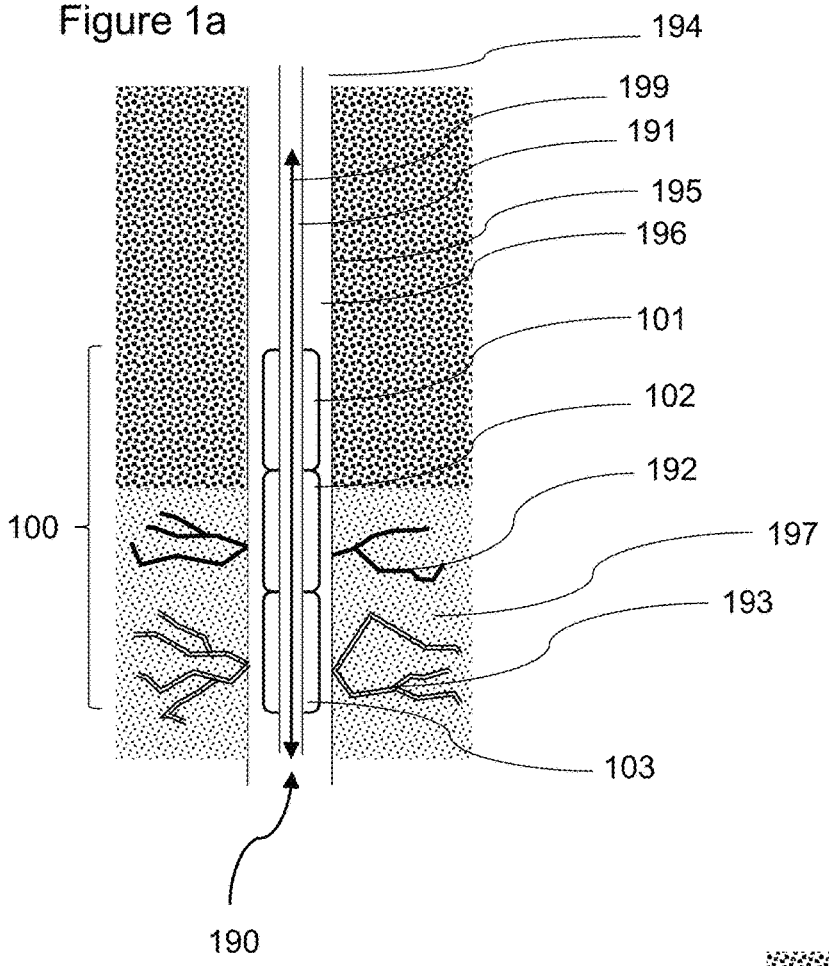
FIG. 1*a*-1*f* is a series of side views of a string with a downhole assembly for injecting acid into a formation.

For some time, the problem of holding a column of fluid (regardless of the specific fluids) has been an issue. In addition, it has been difficult to ensure that, when fluid is introduced into a well, it reaches the desired spot. The equipment may also have to be emptied in order to move the string and reset, thus losing that column of fluid downhole.

The inventors have realized that using a diverter sub may be used to redirect fluids (e.g. acid) between flowing along the string and flowing out into the annulus formed between the string and the wellbore.

The diverter sub may be run above any completion or service packer. The device is typically run in the through-channel position, with the device open through to the bottom. This would allow the operator to manipulate any equipment below the diverter (e.g. hydraulically-activated equipment). Hydraulically-activated equipment may include hydraulic hold-downs or buttons and/or hydraulic set packers.

Once the equipment is in correct position in the wellbore, rotation of the tubing in either the left- or right-hand direction will open the diverter to the annulus and close the diverter to the bottom. The acid can now be pumped into the formation without losing it downhole. The device can then be rotated to the closed position and opened to the bottom. The device can now be moved to a new position in the wellbore and acidizing can commence in the new position.

The present technology relates to a downhole tool for directing fluids in different directions, and in particular a tool which could be used to direct acid to a particular point in the formation/wellbore. The idea is to have a diverter component which has an outer pipe which forms part of the downhole string. The pipe has a through channel and also holes through the wall of the pipe. Within the pipe is a sleeve which can be moved.

In one position, the sleeve blocks the wall holes and allows fluid to pass through the channel of the pipe. In this position, the diverter can be used to control a packer (or another hydraulically controlled tool) positioned below the diverter. The packer would be used to seal off sections of the wellbore (e.g. for an acid treatment).

When the packer is set at the right level within the bore, the sleeve is moved to a second position which seals the channel but opens the holes in the pipe wall. Then acid could be pumped into the formation. When this is done, the sleeve could be moved to the first position again to move the packer and the process could be performed again. This helps having to have multiple runs in and out of the bore. It also helps control where the acid is directed within the wellbore.

Various aspects of the invention will now be described with reference to the figures. For the purposes of illustration, components depicted in the figures are not necessarily drawn to scale. Instead, emphasis is placed on highlighting the various contributions of the components to the functionality of various aspects of the invention. A number of possible alternative features are introduced during the course of this description. It is to be understood that, according to the knowledge and judgment of persons skilled in the art, such alternative features may be substituted in various combinations to arrive at different embodiments of the present invention.

Acid Treatment

FIGS. 1*a*-1*f* shows an acid treatment string within a wellbore. In this case, the string comprises: tubing 191 (e.g. coiled tubing) reaching from surface 194 into the wellbore 191; and a downhole string assembly 100. The tubing 191 is configured to convey materials between the surface to particular positions within the wellbore. The materials may include formation fluid, production fluid, recovery fluid, acid and/or polymer gel. For example, the tubing may be used to inject a pre-treatment fluid before injecting acid in an acid-treatment. Different or a multitude of fluids preform or act differently in wellbores. The operator will determine the treatment sequence will be based on wellbore conditions and what is to be achieved, what fluids to used during the operation. It will also be determined the length of time that fluid will be exposed to the formation.

A downhole string assembly 100 in this case comprises:

an upper packer 101;

a diverter 102 attached to the upper packer 101, the diverter 102 being configured such that:

in a through-channel configuration, a configurable component is positioned to occlude wall holes of the diverter 102 and to allow fluid flow through the diverter within a channel inside the string 190; and in a through-wall configuration, the configurable component is configured to occlude (e.g. block or seal) the string channel and to allow fluid flow from the tubing to flow out into the wellbore annulus 196; and a lower packer 103, the lower packer 103 configured to receive fluid delivered through the diverter 102 when in the through-channel configuration.

In this case, the diverter 102 comprises:

an outer pipe having a pipe wall forming a pipe channel with a pipe-channel inlet and a pipe-channel outlet, and wherein the wall comprises one or more pipe-wall holes configured to allow fluid to pass between the pipe-channel interior and the pipe-channel exterior; and a configurable component, the configurable component being moveable between a through-channel configuration and a through-wall configuration.

In this case, the formation 197 comprises a number of fissures, some of which are relatively open 193 providing a free flow of material and some of which are relatively tight 192. In this context, "tight" refers to a relatively impermeable reservoir rock formation from which hydrocarbon production is difficult. Reservoirs can be tight because of smaller grains or matrix between larger grains, or they might be tight because they consist predominantly of silt- or clay-sized grains, as is the case for shale reservoirs. Stimulation of tight formations can result in increased production from formations that previously would have been abandoned or produced uneconomically.

In this situation, the user wishes to stimulate the relatively tight region of the formation with acid, but they do not wish to lose acid either down the bore hole or into the relatively open regions of the formation 193. It will be appreciated that the open regions may be open due to inherent geology or due to previous stimulation efforts.

As shown in FIG. 1*a*, the string 190 is lowered into the wellbore 195 until the lower packer 103 is positioned above the open fissures 193 and below the tight fissures 192. In this step, the diverter 102 is configured to be in the through-channel configuration in which fluid flow is allowed through the string. This allows material 199 to be injected into or extracted from the wellbore and allows the pressure to be equalized.

Figure 1B:
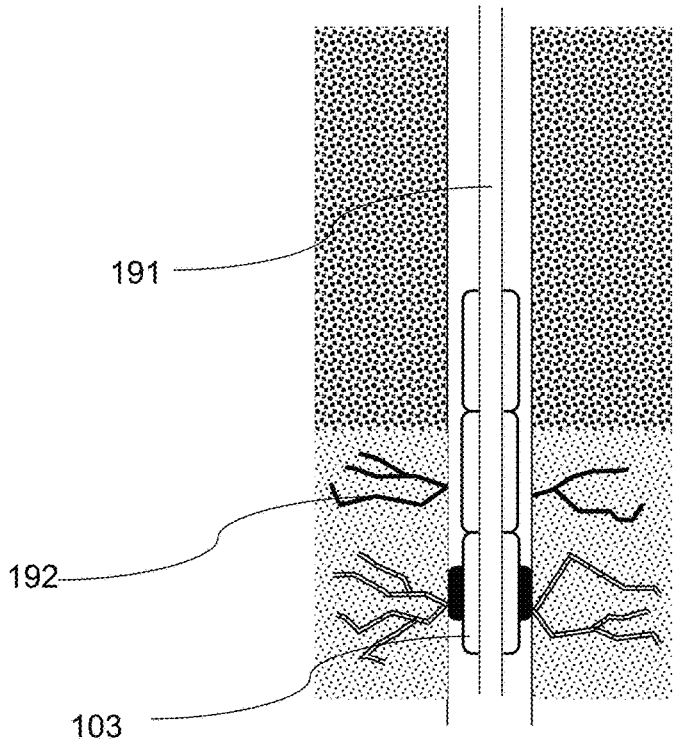

When the lower packer 103 is at the correct level, the lower packer 103 is then activated forming a seal towards the bottom of the string 190 and the wellbore 195, as shown in FIG. 1*b*. In this case, the lower packer 103 is a mechanically-set packer which may be activated and deactivated by rotating the string from the surface 194. Once the packer has been run to the desired depth, the tubing string is rotated to initiate the setting sequence. As the tubing is being rotated, drag blocks (not shown) on the packer are used to hold the packer in place and provide the resistance required to set it.

Figure 1C:
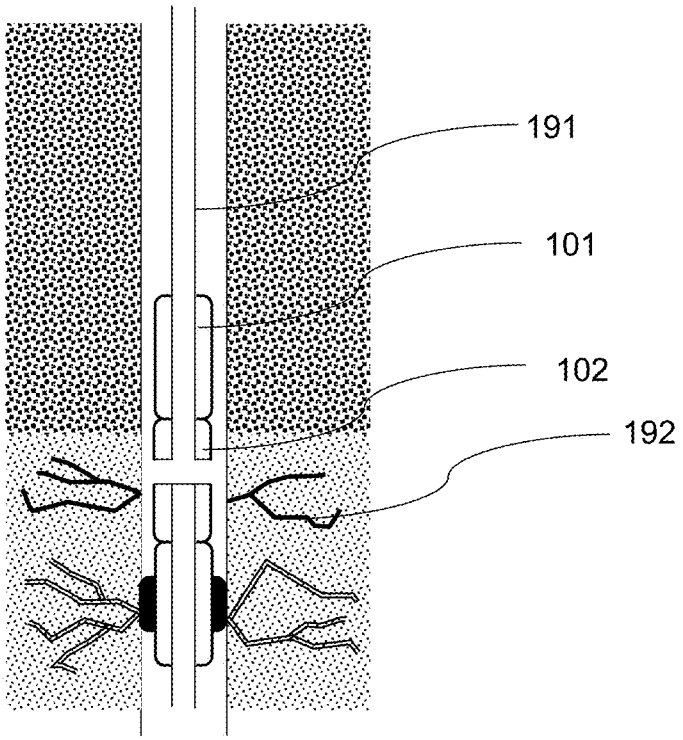

The diverter 102 is also reconfigured from a through-channel configuration to a though-wall configuration as shown in FIG. 1*c*. In this case, the diverter is reconfigurable by rotating the string from the surface. The set lower packer 103 prevents the bottom of the diverter 102 from rotating.

Then the upper packer 101 is set to seal the annulus above the diverter 102. This means that any material introduced into the annulus by the diverter 102 will be constrained between the seals formed by the upper and lower packers. 101, 102

In this case, the upper packer 101 is a compression set packer which is set by lowering the top of the string and the compression force of the string acting against the set lower packer 103 sets the upper packer 101.

Figure 1D:
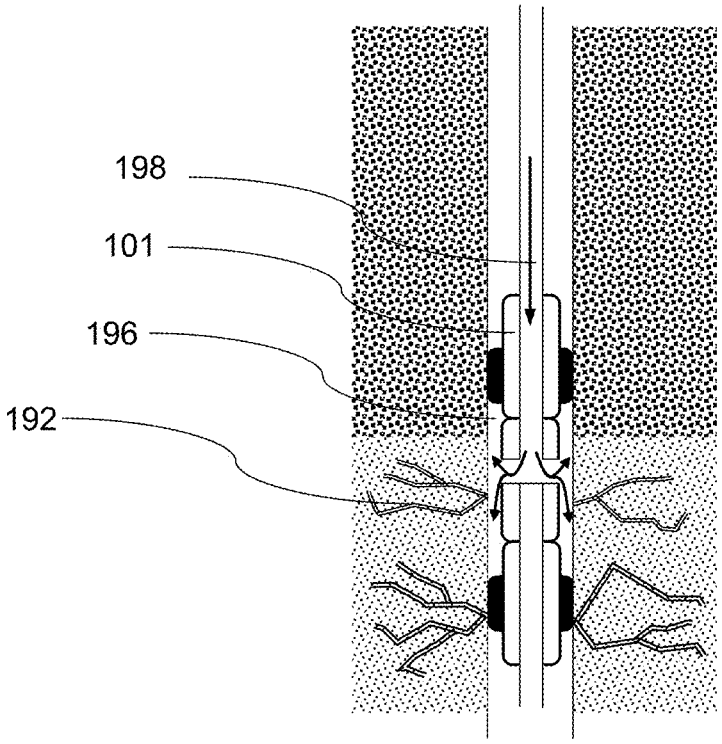

After the upper and lower packers have been set, as shown in FIG. 1*d*, acid 198 is introduced into the annulus 196 and constrained between the seals formed by the upper and lower packers 101, 103. This allows acid to be directed specifically at a particular point along the wellbore. In this case, the acid interacts to stimulate and open the tight part of the formation.

Figure 1E:
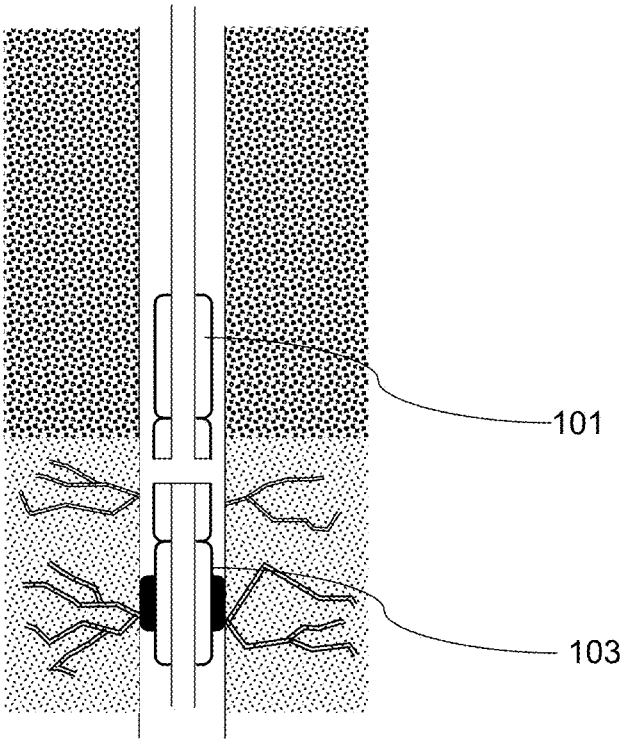
Figure 1F:
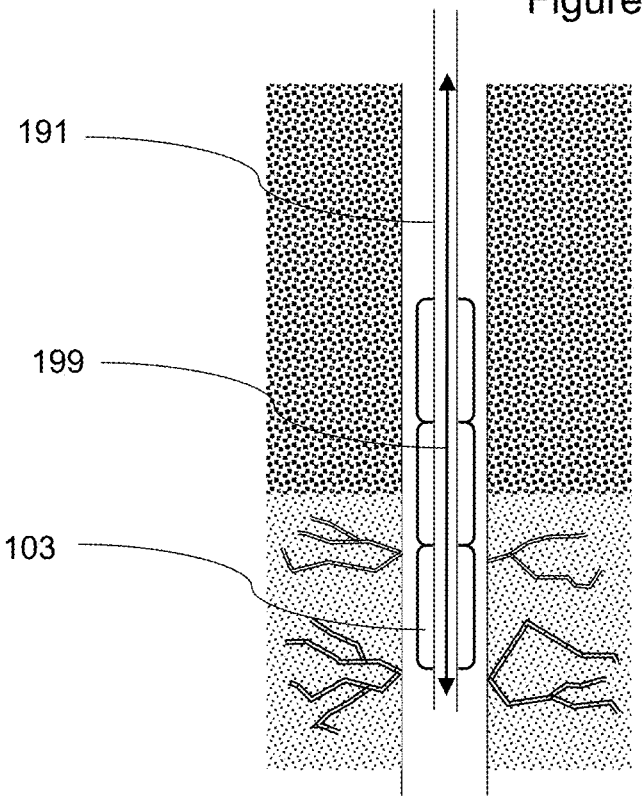

After the stimulation, the string 191 is lifted as shown in FIG. 1*e* to disengage the upper compression set packer 101. Then the string is rotated first to reconfigure the diverter 102 from the through-wall configuration to the through-channel configuration. This allows fluid 199 to flow into the lower region of the wellbore below the lower packer 103. This allows the pressure to be equalized along the length of the wellbore (e.g. and above and below the lower packer 103). Then the string is further rotated to disengage the rotation-set packer (as shown in FIG. 1*f*).

As the diverter 102 is in the through-channel configuration the string can be moved up and down the string within the bore while minimizing pressure differentials along the wellbore. For example, at this stage, it may be desirable not to swab the lower region of the wellbore.

The assembly may then be recovered (e.g. to surface 194) or reset in a different position. For example, the assembly may be positioned next to another tight region of the formation. Then the packers may be reset, and the diverter 102 configured to a through-wall configuration for further acid injections. This may be repeated as many times as is required without running the string out of the wellbore.

Rotation-Set Diverter Sub

Figure 2A:
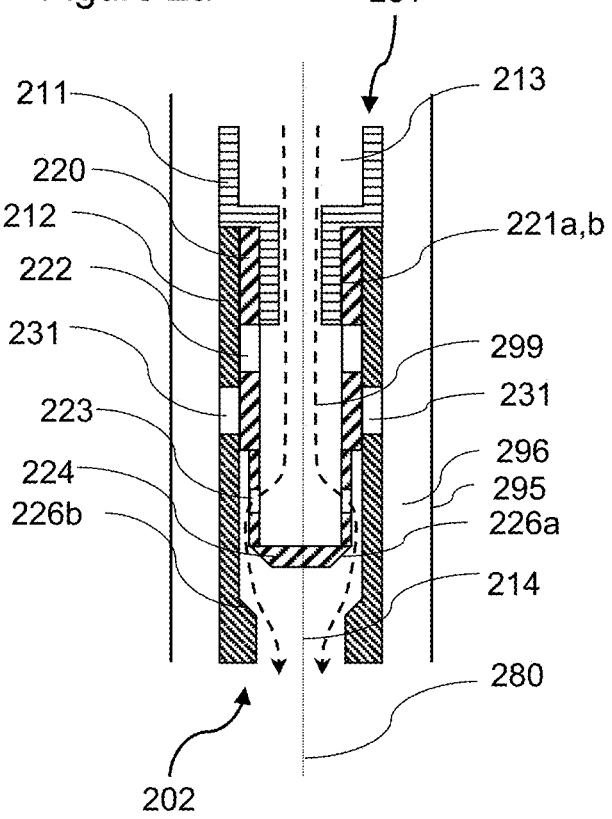
FIG. 2*a*-2*c* are cross-sectional views of a first diverter component in three different configurations.
Figure 2B:
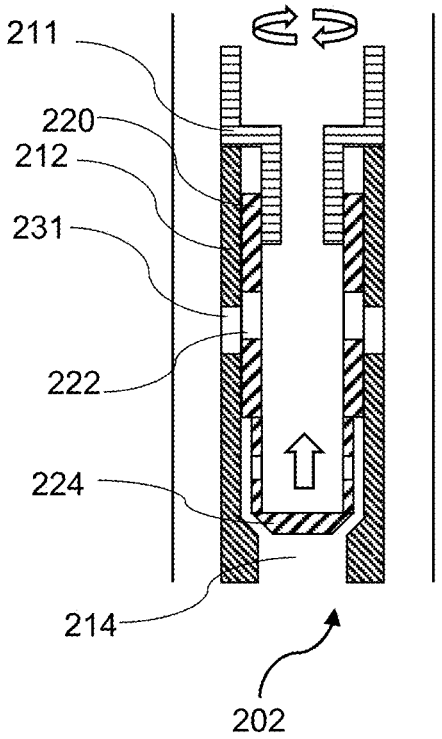
Figure 2C:
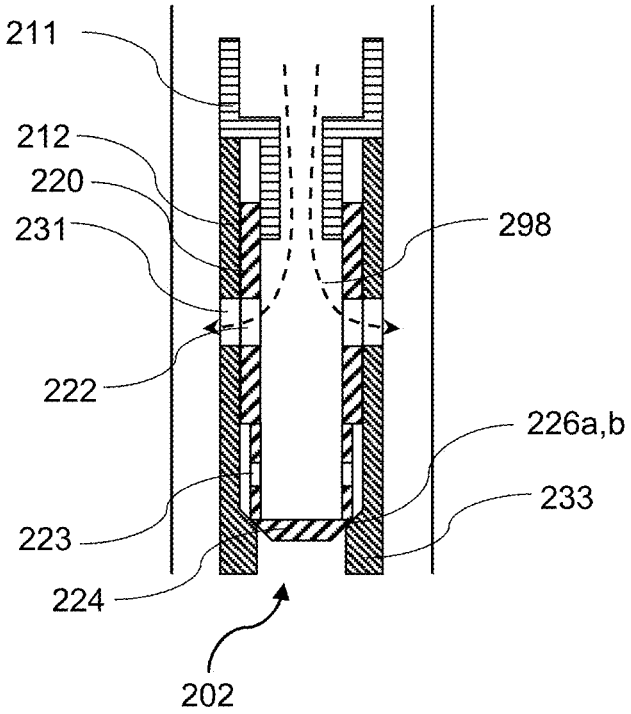

FIGS. 2*a*-2*c* shows an embodiment of a downhole string diverter component which may be used as the diverter in the acid treatment described in relation to FIGS. 1*a*-1*f*.

In this case, the diverter comprises:

an outer pipe 281 formed by a first pipe component 211 and a second pipe component 212, the first and second pipe components being rotatable relative to each over about the diverter axis 280, the outer pipe being configured to provide a pipe wall forming a pipe channel with a pipe-channel inlet 213 and a pipe-channel outlet 214, and wherein the wall comprises one or more pipe-wall holes 231 configured to allow fluid to pass between the pipe-channel interior and the pipe-channel exterior (e.g. into the annulus 296 of the wellbore 295);

an inner sleeve 212, the inner sleeve being configured within the outer pipe 281 and to have a screw engagement 221*a,b* with the first pipe 211 component of the outer pipe and a sliding engagement with the second pipe component 212, and being moveable between a through-channel configuration and a through-wall configuration based on rotation between the first and second components, wherein:

in the through-channel configuration, the inner sleeve 220 is positioned to occlude the wall holes 231 of the outer pipe and to allow fluid flow through the pipe channel; and in the through-wall configuration, the inner sleeve 220 is configured to occlude the pipe channel and to allow fluid flow through the pipe wall holes 231.

That is, the diverter 202, in this case, comprises three rigid components which are moveable with respect to each other: the first pipe component 211 (hatched with horizontal lines); the second pipe component 212 (hatched with fine diagonal lines); and the sleeve 220 (hatched with thick diagonal lines).

The first pipe component 211 is rotatably engaged with the second pipe component 212 to allow relative rotation of the first and second pipe components about the diverter or string axis 280. The sleeve 220 engages with both the first and second pipe components 211, 212 and is configured to be translated up and down the diverter axis 280 based on the relative rotation of the first and second pipe components 211, 212.

In FIG. 2*a*, the diverter 202 is shown in the through-channel configuration which allows material to pass freely between the diverter inlet 213 and diverter outlet 214. In this disclosure, the inlet and outlet are named based on the diverter's function of injecting material into the wellbore from the surface. It will be appreciated that retrograde flow is also possible with materials entering the diverter outlet and exiting the diverter inlet (e.g. as might be the case if material had to be extracted from the wellbore).

In this case, the sleeve 220 comprises a screw portion 221*a* which is configured to engage with a complementary screw portion 221*b* of the upper first pipe component 211. In this case, the sleeve screw portion 221*a* faces inwards towards the diverter axis 280 and the first pipe component screw portion 221*b* faces outwards away from the diverter axis 280. This means that the top of the sleeve 220 is positioned radially between the first and second pipe components 211, 212.

In this case, the sleeve 220 further comprises a hole portion with one or more holes 222, in this case, positioned below the sleeve screw portion 221*a*. In the open configuration, the holes 222 are configured not to align with corresponding through-wall holes 231 in the second pipe component. This prevents fluid 299 within the pipe escaping into the annulus 296 through the through-wall holes 231 in the second pipe component.

In this case, both the sleeve holes 222 and the through-wall holes 231 are mounted in surfaces which are aligned with (e.g. parallel to) the diverter axis.

In this case, the sleeve 220 further comprises one of more lugs (not shown), configured to engage with one or more corresponding slots in the second pipe components, the engaged lug and slot arrangement guides the sleeve up and down within the pipe as the first components is rotated with respect to the lower component. This rotation moves the sleeve via the engaged screw portions. The slot may be configured to align with the diverter axis. It will be appreciated that, in other embodiments, the slot may be in the sleeve and the lug may protrude from the second pipe portion.

The sleeve 220 further comprises one or more sleeve outlets 223 configured to allow fluid to exit the sleeve portion into the pipe channel and towards the diverter outlet 214. In this case, the sleeve outlets 223 are located on surfaces which lie parallel to the diverter axis 280 (e.g. vertical surfaces when the diverter is held upright as shown in FIG. 2*a*). In this case, at the position of the sleeve outlets, the outer diameter of the sleeve 220 is less than the inner diameter of the second pipe component 212. In this case, the outer diameter of the sleeve 220 at the location of the sleeve outlets 223 is less than the inner diameter of the second pipe component 212 regardless of whether the sleeve is in the through-channel configuration (FIG. 2*a*) or the through-wall configuration (FIG. 2*c*).

At the bottom of the sleeve 224, in this case, there is provided a plug portion. In the through-channel configuration (see FIG. 2*a*), the plug portion is raised, and so fluid 299 can flow through the sleeve outlets 223 and around the plug 224 and through a central pipe outlet 214 and on through the string.

As shown in FIG. 2*b*, the first pipe component 211 is rotatable with respect to the second pipe component 212. The engaged screw portions move the sleeve 220 as a result of this relative rotation. The sleeve portion is prevented from freely rotating due to the engaged lug and slot mechanism. This means that the sleeve moves up and down along the slot.

In FIG. 2*b*, the sleeve is in an intermediate position between the through-channel configuration and the through-wall configuration. In this embodiment, the diverter is configured such that in some intermediate configurations the through-wall holes 231 are partially open at the same time as fluid is allowed to flow through the channel.

In FIG. 2*c*, the sleeve 220 is fully lowered, and the sleeve holes 222 are configured to align with the through-wall holes 231 in the second pipe component. In addition, the plug 224 is lowered to impinge on a narrower portion 233 of the second pipe component. This allows material 298 (e.g. an acid treatment) to be injected downhole into the annulus.

That is, the sleeve and the outer pipe comprise complementary annular surfaces 226*a,b*, the annular surfaces being arranged at an angle to the pipe axis such that:

when the complementary annular surfaces abut by moving the inner sleeve within the pipe along the pipe axis, the pipe channel is occluded; and when the complementary annular surfaces are spaced apart by moving the inner sleeve within the pipe along the pipe axis, fluid flow is allowed through the pipe channel.

In this case, the annular surfaces 226*a,b* are angled downwardly and inwardly which may help seat the plug and provide a better seal.

It will be appreciated that the diverter 202 is configured such that rotating the first pipe component 211 in one direction moves the sleeve 220 down and the rotating in the opposite direction moves the sleeve 220 up. Because the sleeve 220 and both pipe components 211, 212 are fully mechanically engaged (e.g. the position of the sleeve 220 is completely dependent on the relative rotation of the upper and lower pipe components 211, 212 rather than, for example, flow rate within the pipe), the user may be able to more accurately and reproducibly control the configuration of the sleeve 220 within the pipe by rotating the string from the surface. This may allow the user to configure more accurately the diverter to be in a through-channel configuration or in a through-wall configuration or in a particular intermediate configuration.

Figure 3A:
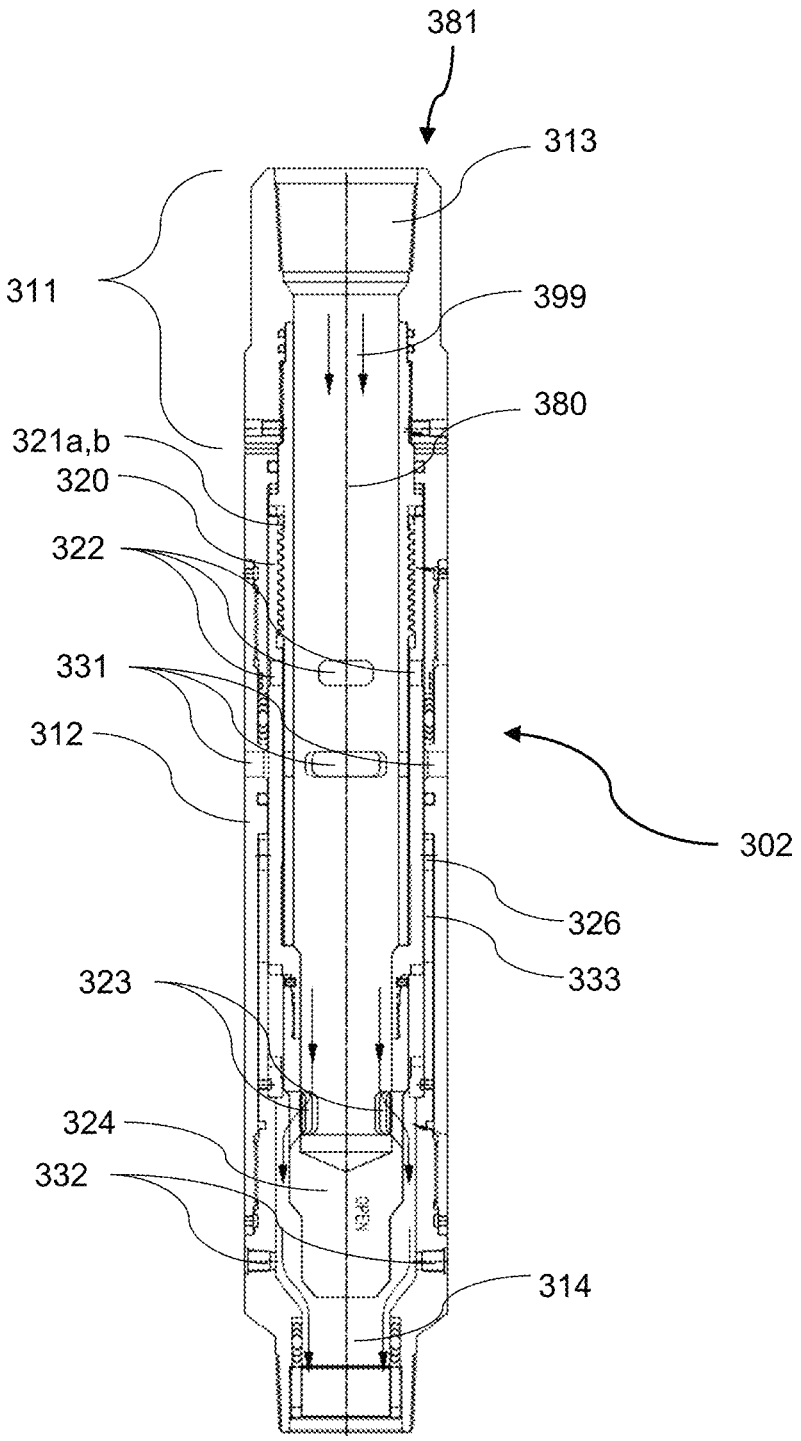
FIG. 3*a*-3*b* are cross-sectional views of a second diverter component in two different configurations.
Figure 3B:
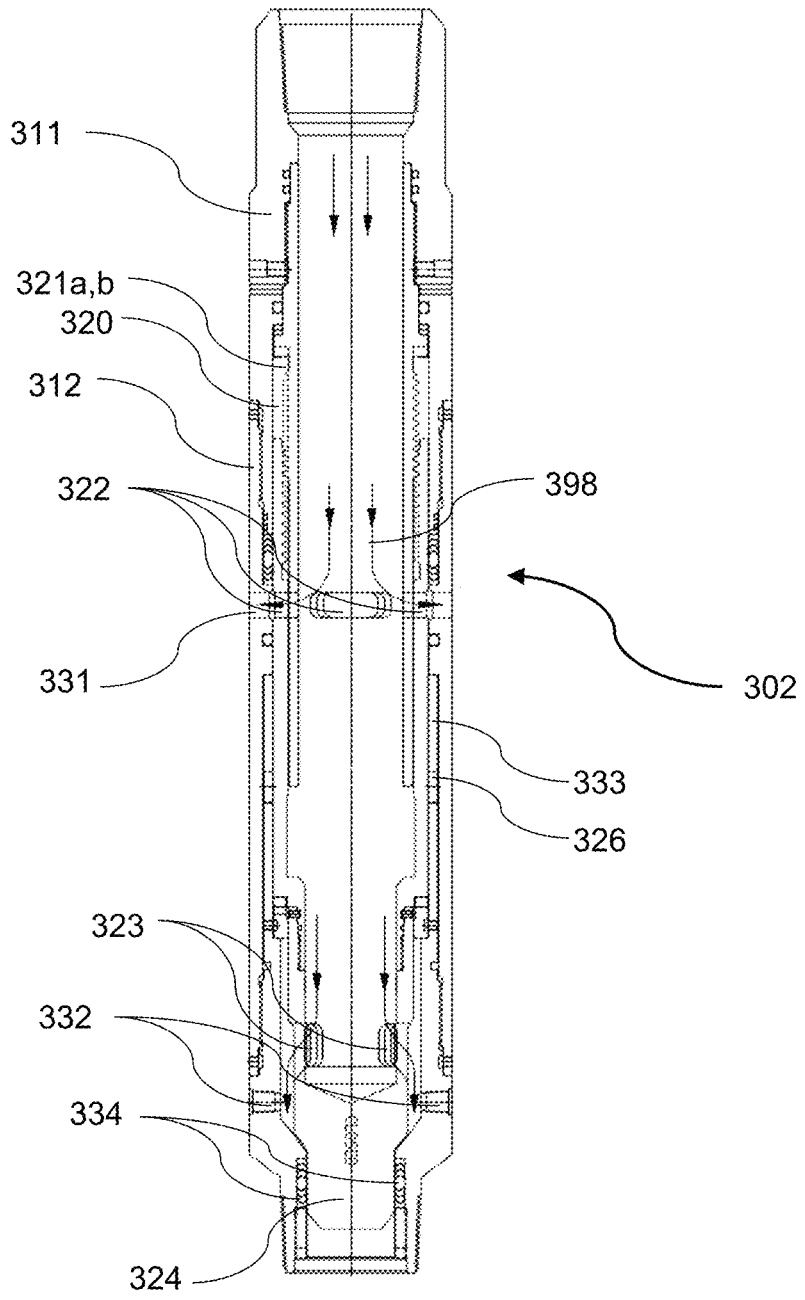

FIGS. 3*a*-3*b* shows an embodiment of a downhole string diverter component 302 which may be used as the diverter in the acid treatment described in relation to FIGS. 1*a*-1*f*.

Like the embodiment of FIG. 2*a*, the diverter of FIG. 3*a*-*b* comprises:

an outer pipe 381 formed by a first pipe component 311 and a second pipe component 312, the first and second pipe components being rotatable relative to each over about the string or diverter axis 380, the outer pipe 313 being configured to provide a pipe wall forming a pipe channel with a pipe-channel inlet 313 and a pipe-channel outlet 314, and wherein the wall comprises one or more pipe-wall holes 331 configured to allow fluid to pass between the pipe-channel interior and the pipe-channel exterior (e.g. into an annulus between the diverter or string and the wellbore);

an inner sleeve 320, the inner sleeve being configured within the outer pipe 381 and to have a screw engagement 321*a,b* with the first pipe component 311 of the outer pipe and a sliding engagement with the second pipe component 312, and being moveable between a through-channel configuration (see FIG. 3*a*) and a through-wall configuration (see FIG. 3*b*) based on rotation between the first and second components 311, 312, wherein:

in the through-channel configuration, the inner sleeve is positioned to occlude the wall holes of the outer pipe and to allow fluid flow through the pipe channel; and in the through-wall configuration, the inner sleeve is configured to occlude the pipe channel and to allow fluid flow through the pipe wall holes.

That is, the diverter component 302 comprises three rigid components which are moveable with respect to each other: the first pipe component 311; the second pipe component 312; and the sleeve 320.

FIG. 3*a* shows the diverter 302 in the through-channel configuration. Like the embodiment of FIG. 2*a*, the sleeve in this case, is configured to engage with the first pipe component 311 within complementary screw portions 321*a,b*. The sleeve also engages with the second pipe component 312 via a complementary lug 326 (in this case, part of the sleeve) and slot arrangement 333 (in this case part of the second pipe component).

Also like the previous embodiment, the sleeve 320 comprises one or more one or more sleeve outlets 323 configured to allow fluid to exit the sleeve into the pipe channel above the sleeve plug 324. In this case, the sleeve outlets 323 are located on surfaces which are aligned (e.g. lie parallel to) the diverter axis (e.g. vertical surfaces when the diverter is held upright as shown in FIG. 3*a*).

In this case, at the position of the sleeve outlets 323, the outer diameter of the sleeve 320 is less than the inner diameter of the second pipe component 312 with a gap in between. In this case, the outer diameter of the sleeve 320 is less than the inner diameter of the second pipe component 312 regardless of whether the sleeve is in the through-channel configuration (FIG. 3*a*) or the through-wall configuration (FIG. 3*c*).

Unlike the previous embodiment, the pipe 313 of the embodiment of FIG. 3*a* comprises vents 332 which are configured to be permanently open (and in fluid communication with the diverter inlet 313) regardless of the configuration of the sleeve 320. These vents 332 allow fluid communication between the upper portion of the string (and/or the diverter inlet 313) and the annulus when the diverter is in the through-channel configuration and when the diverter is in the through-wall configuration.

In the through-channel configuration of FIG. 3*a*, material 399 can freely move up and down within the string. In the through-wall configuration of FIG. 3*b*, material 398 (e.g. acid) can be injected into, or retrieved from, the annulus outside the diverter.

In this embodiment 302, the vents 332 are located towards the bottom of the diverter and above the pipe outlet 314. When the diverter is in the through-wall configuration (see FIG. 3*b*) or in the through-channel configuration (see FIG.

3*a*), the vents 332 are positioned in the region where the sleeve outer diameter is narrower than the inner diameter of the second pipe component. This allows fluid communication between the diverter inlet 313 and the annulus (outside the diverter walls) via the sleeve outlets 323 and the vents 332 regardless of whether the diverter 302 is in the through-wall configuration or in the through-channel configuration. This may help equalize pressure between the inside and outside of the diverter even in the through-channel configuration. If the pressure is equalized, fluid flow may be directed past the vents in the through-channel configuration. For example, when the diverter is in an upright position, gravity may help pull fluid past the vents.

The vents may be plugged with plugs at surface. The vents may be angled such inwards and downwards. This may help flow down through the string to be directed through the channel when the diverter is in the through-channel configuration. The vents may be positioned above, below or to the side of the sleeve outlets on one or both of the through-channel and through-wall configurations. This may help reduce the risk of material being injected directly into the vents by the sleeve outlets.

In this case, the plug comprises a protrusion which is configured to insert into the diverter outlet 314. This may help occlude the diverter channel outlet 314. The second pipe component in this case comprises seals on the vertical surfaces (e.g. aligned with or parallel to the diverter axis 380) to seal against the sides of the protrusion to provide a better seal. The current seal configuration may comprise a molyglass Teflon Vee Seal. There are options for the tool to use bonded seals, standard nitrile material or high temperature materials. This may then allow the equipment to be run in other applications.

Compression-Set Diverter Sub

Figure 4A:
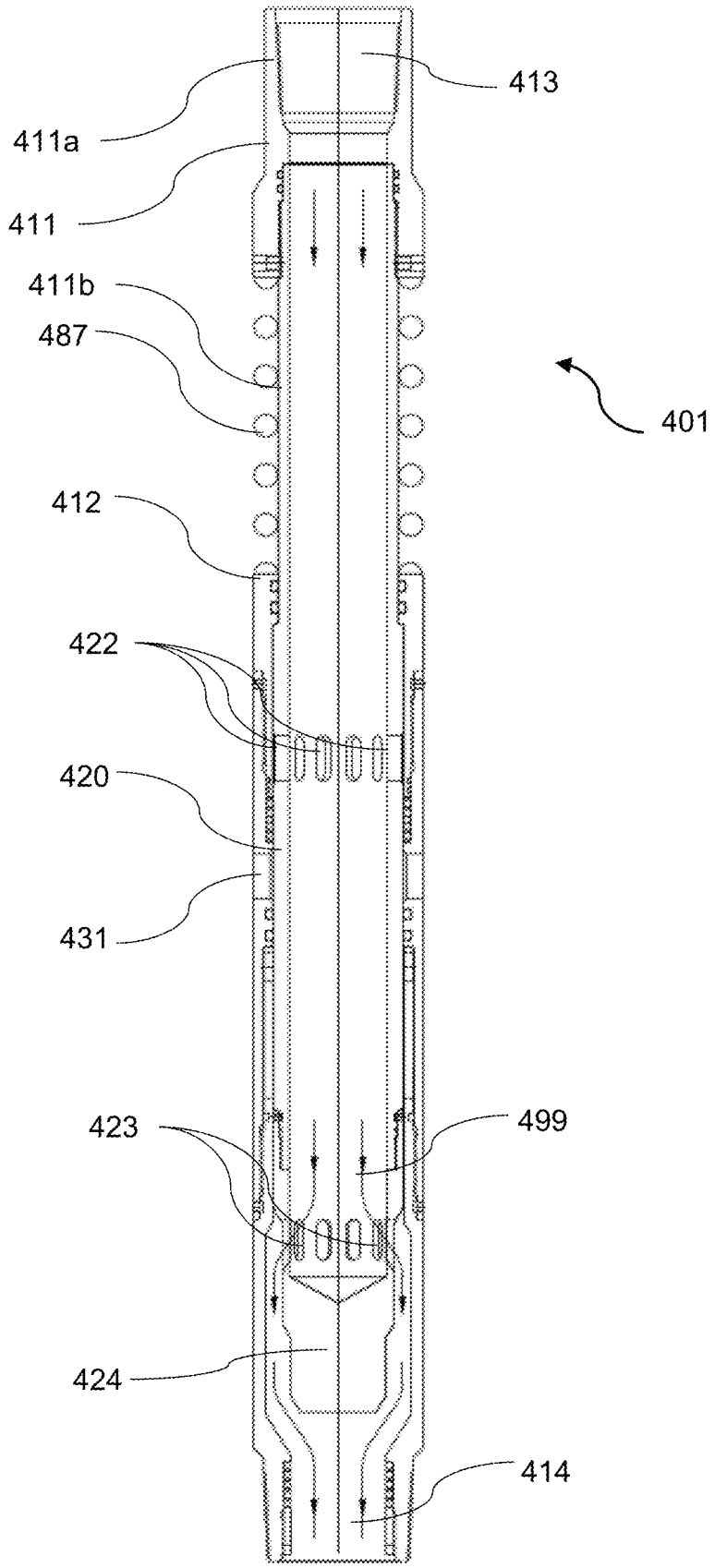
FIG. 4*a*-4*b* are cross-sectional views of a third diverter component.
Figure 4B:
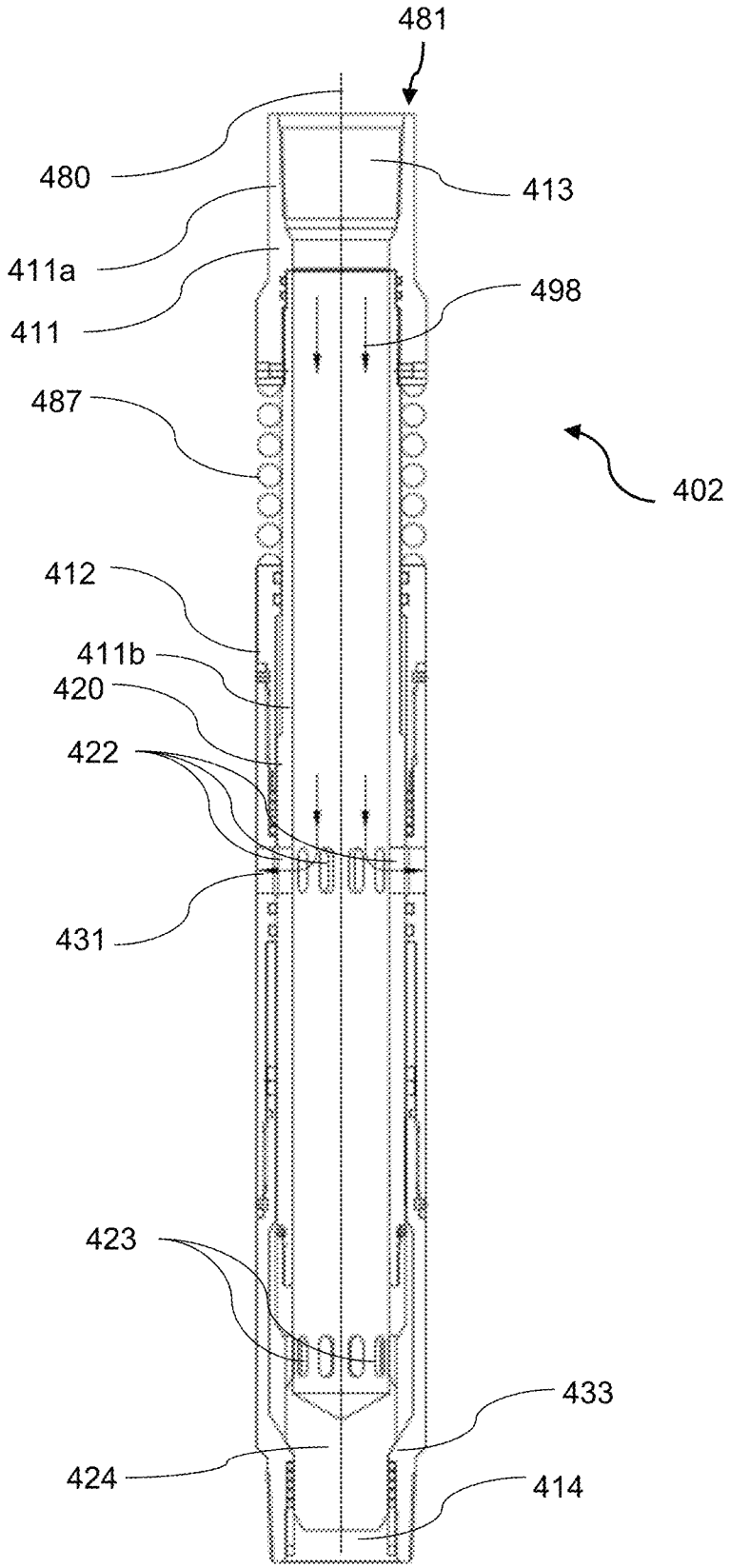
Figure 4C:
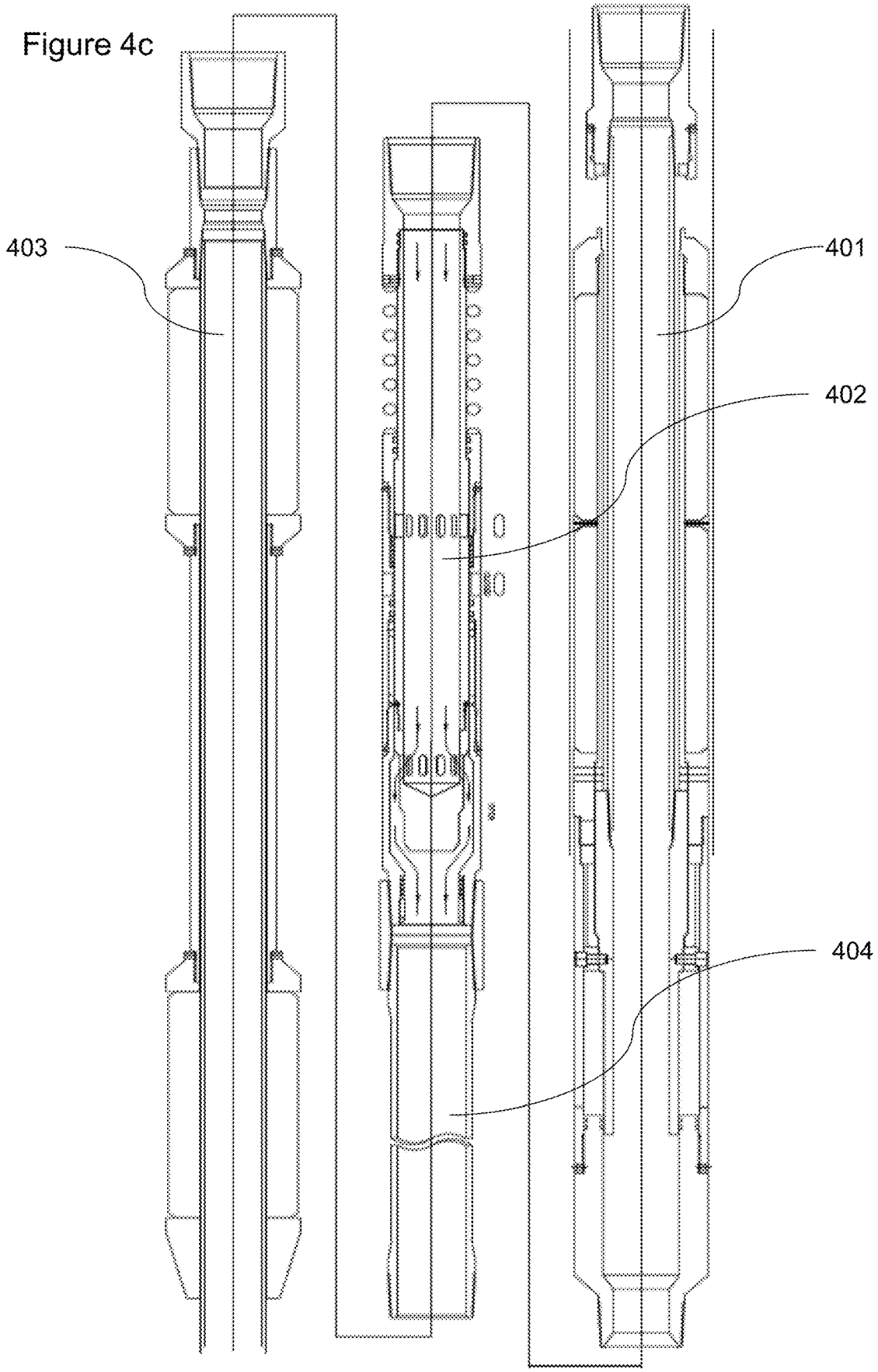
FIG. 4*c* is a cross-sectional view of a downhole assembly comprising the diverter component of FIG. 4*a* and upper and lower packers.

FIGS. 4*a* and 4*b* show an alternative diverter component 402. FIG. 4*a* shows the diverter in a through-channel configuration and FIG. 4*b* shows the diverter in a through-wall configuration. FIG. 4*c* shows the diverter component forming part of a downhole assembly having upper and lower packers.

In this case the diverter comprises:

an outer pipe 481 formed by first 411 and second 412 pipe components, the first and second pipe 411, 412 components being telescopically engaged along the diverter axis 480 and forming a pipe channel with a pipe-channel inlet 413 and a pipe-channel outlet 414, wherein the second component comprises one or more pipe-wall holes 431 configured to allow fluid to pass between the pipe-channel interior and the pipe-channel exterior (e.g. into a wellbore annulus);

and wherein the first component comprises an inner sleeve 420, the inner sleeve 420 being configured to have a telescopic engagement with the second component 412, and being moveable between a through-channel configuration and a through-wall configuration based on movement of the first component relative to the second component along the diverter axis, wherein:

- in the through-channel configuration, the inner sleeve is positioned to occlude the wall holes of the second component and to allow fluid flow through the pipe channel; and
- in the through-wall configuration, the inner sleeve is configured to occlude the pipe channel and to allow fluid flow through the pipe wall holes.

Unlike the embodiments of FIGS. 2*a* and 3*a*, the diverter 402 in this case comprises two rigid components which are moveable with respect to each other: the first pipe component 411 and the second pipe component 412. The inner sleeve 420 in this case forms part of the first pipe component 411. However, like the embodiments of FIGS. 2*a* and 3*a*, the configuration of the diverter (e.g. whether it is in the through-channel or through-call configuration) is defined by the configuration of the first component relative to the second component. That is, when the lower second component is fixed (e.g. rigidly attached to an engaged packer), the diverter can be moved between the through-channel and through-wall configuration by moving the first component from the surface.

The first pipe component 411 is telescopically engaged with the second pipe component 412 to allow relative translation or movement of the first and second pipe components along the diverter or string axis 480. The sleeve 420 engages with the second pipe component 412 and is configured to be translated up and down the diverter axis 480 based on the relative compression and extension of the diverter 402 along the diverter axis 480.

The first component 411 comprises three portions: a head portion 411*a* which has a large outer diameter for engaging with a biasing spring; a waisted portion 411*b* which is configured to slide into and out of the second pipe component as the diverter is moved between the through-wall and through-channel configurations; and the sleeve portion 420 which is positioned within the second pipe component in both the through-wall and through-channel configurations.

The outer diameter of the sleeve portion 420 is larger than that of the waisted portion 411*b*. This waisted portion 411*b* slides within a seal with an inner collar at the top of the second pipe component. When the diverter is extended along the diverter axis the first component can not be pulled apart from the second component because the sleeve portion is too wide to pass through the collar.

In this case, the diverter is biased towards the extended through-channel configuration by means of a spring 487. This spring is positioned around the outside of the channel wall between the top of second component 412, below a wider head portion 411*a* of the first component 411 and around the waisted portion 411*b*. It will be appreciated that other biasing mechanism may be used.

The biasing mechanism means that, in this embodiment, the diverter can be put in the through-wall configuration only by compressing the diverter along the diverter axis. Generally, this means that a lower packer will first need to be set before set-down pressure can be applied from the surface in order to inject material into the annulus. It will be appreciated that other embodiments may be biased towards the through-channel configuration (e.g. by having the wall holes of the second component towards the top).

In FIG. 4*a*, the diverter 402 is shown in the through-channel configuration which allows material to pass freely between the diverter inlet 413 and diverter outlet 414. As noted above, in this disclosure, the inlet and outlet are named based on the diverter's function of injecting material into the wellbore from the surface. It will be appreciated that retrograde flow may also be possible with materials entering the diverter outlet and exiting the diverter inlet (e.g. as might be the case if material had to be extracted from the wellbore).

In this case, the sleeve 420 further comprises a hole portion with one or more holes 422. In the through-channel configuration, the holes 422 are configured not to align with corresponding through-wall holes 431 in the second pipe component. This prevents fluid 499 within the pipe escaping into the annulus through the through-wall holes 431 in the second pipe component.

In this case, both the sleeve holes 422 and the through-wall holes 431 are mounted in surfaces which are aligned with (e.g. parallel to) the diverter axis.

The sleeve 420 further comprises one or more sleeve outlets 423 configured to allow fluid to exit the sleeve portion into the pipe channel and towards the diverter outlet 414. In this case, the sleeve outlets 423 are located on surfaces which lie parallel to the diverter axis 480 (e.g. vertical surfaces when the diverter is held upright as shown in FIG. 4*a*). In this case, at the position of the sleeve outlets, the outer diameter of the sleeve 420 is less than the inner diameter of the second pipe component 412. In this case, the outer diameter of the sleeve 420 at the location of the sleeve outlets 423 is less than the inner diameter of the second pipe component 412 regardless of whether the sleeve is in the through-channel configuration (FIG. 4*a*) or the through-wall configuration (FIG. 4*b*).

At the bottom of the sleeve, in this case, there is provided a plug portion 424. In the through-channel configuration (see FIG. 4*a*), the plug portion is raised, and so fluid 499 can flow through the sleeve outlets 423 and around the plug 424 and through a central pipe outlet 414 and on through the string.

As shown in FIGS. 4*a* and 4*b*, the first pipe component 411 is translatable with respect to the second pipe component 412.

In FIG. 4*b*, the sleeve 420 is fully lowered, and the sleeve holes 422 are configured to align with the through-wall holes 431 in the second pipe component. In addition, the plug 424 is lowered to impinge on a narrower portion 433 of the second pipe component. This allows material 498 (e.g. an acid treatment) to be injected downhole into the annulus.

In this case, the sleeve and the outer pipe comprise complementary annular surfaces, the annular surfaces being arranged at an angle to the pipe axis such that:

when the complementary annular surfaces abut by moving the inner sleeve within the pipe along the pipe axis, the pipe channel is occluded; and when the complementary annular surfaces are spaced apart by moving the inner sleeve within the pipe along the pipe axis, fluid flow is allowed through the pipe channel.

In this case, the annular surfaces are angled downwardly and inwardly which may help seat the plug and provide a better seal.

It will be appreciated that the diverter of FIG. 4*a* could be used to control the injection of acid into a wellbore during an acid treatment.

FIG. 4*c* shows a diverter assembly comprising an upper packer 401, the diverter 402 of FIG. 4*a*, and a lower packer 403. The components of the diverter assembly are shown side by side to better match the aspect ratio of the page. It will be appreciated that the components would be connected in a line along a common axis.

In this case, the diverter 402 is connected to a spacer 404 which, in this case, is a pipe. This pipe spacer allows the straddle between the seal formed by the upper packer and the seal formed by the lower packer to be adjusted easily by selecting the pipe spacer with the appropriate length. For example, if the user wished to inject acid along a particular length of the wellbore, they would select a spacer to ensure that the upper and lower packers could be positioned just above and just below that particular length of wellbore, thereby allowing a targeted acid treatment.

In this case, the lower packer is configured to be set by positioning the packer in place, then lifting the string making a partial turn (e.g. a ¼ turn) and then setting down.

The upper packer is a compression-set packer. In this case, the upper packer has a greater set-down force than the diverter set-down force so that as more weight is applied to the string, the diverter sets (compresses to the through-wall configuration) before the upper packer sets. In this case, the diverter is configured to set at 2,000 lbs (around 9,000 N) and the packer is configured to set at 9,000 lbs (40,000 N).

Other Options

The upper packer may be a rotation-set packer.

The threading of the complementary screw portions of the diverter may be right-handed or left-handed. The rotation setting of the lower packer may be right-handed or left-handed.

The examples shown above have been vertical wellbores. It will be appreciated that this technology may be applied to horizontal wells.

Although the present invention has been described and illustrated with respect to preferred embodiments and preferred uses thereof, it is not to be so limited since modifications and changes can be made therein which are within the full, intended scope of the invention as understood by those skilled in the art.

The invention claimed is:

1. A downhole string assembly comprising:

an upper packer;

a diverter component attached to and below the upper packer, the diverter component comprising:

an outer pipe having a pipe wall forming a pipe channel with a pipe-channel inlet and a pipe-channel outlet, and wherein the wall comprises one or more pipe-wall holes configured to allow fluid to pass between the pipe-channel interior and the pipe-channel exterior;

a configurable component, the configurable component being moveable between a through-channel configuration and a through-wall configuration, wherein:

in the through-channel configuration, the configurable component is positioned to occlude the wall holes of the outer pipe and to allow fluid flow through the pipe channel; and in the through-wall configuration, the configurable component is configured to occlude the pipe channel and to allow fluid flow through the pipe wall holes; and a lower packer, the lower packer configured to receive fluid delivered through the diverter component when in the through-channel configuration, wherein the diverter and the lower packer are configured such that:

in response to rotation of the string in a first direction, the lower packer is configured first to set, and then the diverter is configured to move to the through-wall configuration; and in response to rotation of the string in a second opposite direction, the diverter is configured first to move to the through-channel configuration and then the lower packer is configured to unset to allow the string to be moved within the wellbore.

2. The downhole string assembly according to claim 1, wherein the upper packer is a compression set packer.

3. A downhole string component comprising:

an outer pipe formed by a first pipe component and a second pipe component, the first and second pipe components being rotatable relative to each over about the diverter axis, the outer pipe being configured to provide a pipe wall forming a pipe channel with a pipe-channel inlet and a pipe-channel outlet, and wherein the wall comprises one or more pipe-wall holes configured to allow fluid to pass between the pipe-channel interior and the pipe-channel exterior;

an inner sleeve, the inner sleeve being configured within the outer pipe and to have a screw engagement with the first pipe component of the outer pipe and a sliding engagement with the second pipe component, and being moveable between a through-channel configuration and a through-wall configuration based on rotation between the first and second components, wherein:

in the through-channel configuration, the inner sleeve is positioned to occlude the wall holes of the outer pipe and to allow fluid flow through the pipe channel; and in the through-wall configuration, the inner sleeve is configured to occlude the pipe channel and to allow fluid flow through the pipe wall holes.

4. The downhole string component of claim 3 wherein the inner sleeve is rigid.

5. The downhole string component according to claim 3 wherein the inner sleeve comprises a sleeve wall has one or more sleeve-wall holes and wherein the sleeve wall is configured to occlude the pipe holes in the through-channel configuration, and the sleeve-wall holes are configured to align with the pipe holes in the through-wall configuration.

6. The downhole string component according to claim 3 wherein the inner sleeve comprises a plug positioned towards a lower end, wherein the plug is configured to occlude the pipe-channel outlet in the through-wall configuration.

7. The downhole string component according to any claim 3 wherein the outer pipe comprises one or more vents which are open in both through-channel and through-wall configurations and are configured to allow fluid communication between the pipe-channel interior and the pipe-channel exterior.

8. The downhole string component according to claim 7, wherein the vents are sealable by plugs.

9. The downhole string component according to claim 3 wherein the inner sleeve comprises a sleeve wall forming a sleeve channel with a sleeve channel inlet and a sleeve channel outlet.

10. The downhole string component according to claim 3 wherein the inner sleeve comprises a sleeve wall having sleeve-wall holes and wherein the sleeve wall is configured to occlude the pipe holes in the through-channel configuration, and the sleeve-wall holes are configured to align with the pipe holes in the through-wall configuration.

11. The downhole string component according to claim 3 wherein the inner sleeve and the outer pipe comprise complementary annular surfaces within the pipe channels, the annular surfaces being arranged at an angle to the pipe axis such that:

when the complementary annular surfaces abut by moving the inner sleeve within the pipe along the pipe axis, the pipe channel is occluded; and when the complementary annular surfaces are spaced apart by moving the inner sleeve within the pipe along the pipe axis, fluid flow is allowed through the pipe channel.

12. The downhole string component according to claim 3 wherein the sleeve comprises sleeve outlets located on surfaces which lie parallel to the diverter axis.

13. A method of using a downhole string to introduce an acid treatment, the string comprising an upper packer, a diverter and a lower packer positioned below the diverter, wherein the diverter is configurable between a through-channel configuration and a through-wall configuration, wherein:

in the through-channel configuration, fluid flow is allowed through the string; and in the through-wall configuration, the fluid flow in the string is diverted into the annulus above the lower packer by the diverter, the method comprising:

lowering a string into a wellbore in a through-channel configuration to a first position, when in the first position:

rotating the string in a first direction to first configure the lower packer to set and to configure the diverter from the through-channel configuration to the through-wall configuration;

introducing acid into the annulus after the diverter has been configured to the through-wall configuration and after the upper packer has been set; and rotating the string in a second opposite direction to move the diverter to the through-channel configuration and to unset the lower packer to allow the string to be moved within the wellbore.

14. The method of claim 13, wherein the method comprises setting the upper packer when the lower packer is set;

and wherein acid is introduced into the annulus after the diverter has been configured to the through-wall configuration and after the upper packer has been set.

15. The method according to claim 13, wherein the acid comprises hydrochloric acid.

* * * * *